US010034072B2

(12) United States Patent
Chen

(10) Patent No.: US 10,034,072 B2
(45) Date of Patent: Jul. 24, 2018

(54) INFLATABLE SPEAKER

(71) Applicant: Seksun Corporation Limited, Shenzhen, Guangdong (CN)

(72) Inventor: Songping Chen, Guangdong (CN)

(73) Assignee: Seksun Corporation Limited, Shenzhen (CN)

( * ) Notice: Subject to any disclaimer, the term of this patent is extended or adjusted under 35 U.S.C. 154(b) by 0 days.

(21) Appl. No.: 15/647,258

(22) Filed: Jul. 11, 2017

(65) Prior Publication Data

US 2018/0048949 A1 Feb. 15, 2018

(30) Foreign Application Priority Data

Aug. 9, 2016 (CN) ..... 2016 1 0649665

(51) Int. Cl.

| | |
|---|---|
| ***H04R 1/02*** | (2006.01) |
| ***A63H 23/00*** | (2006.01) |
| ***H04R 1/10*** | (2006.01) |
| *H04R 5/02* | (2006.01) |

(52) U.S. Cl.

CPC ..... *H04R 1/025* (2013.01); *A63H 23/00* (2013.01); *H04R 1/1025* (2013.01); *H04R 5/02* (2013.01)

(58) Field of Classification Search

CPC ..... H04R 1/025; H04R 1/1025; H04R 5/02; A63H 23/00

See application file for complete search history.

(56) References Cited

U.S. PATENT DOCUMENTS

| | | | | |
|---|---|---|---|---|
| 9,016,886 B2 | 4/2015 | Snyder | | |
| 2009/0175483 A1* | 7/2009 | Huang | ..... | H04R 1/026 381/386 |

FOREIGN PATENT DOCUMENTS

| | | |
|---|---|---|
| CN | 201893892 U | 7/2011 |
| CN | 103807613 A | 5/2014 |

* cited by examiner

*Primary Examiner* — Andrew L Sniezek

(57) ABSTRACT

An inflatable speaker includes a collapsible inflatable housing and a loudspeaker, the collapsible housing includes a circumferential side wall, a first end wall, a second end wall, and a valve for inflating the collapsible inflatable housing, wherein the first end wall includes a first inner layer, a first outer layer, and a speaker support plate between them provided with an audio transmission inner sound hole, the first outer layer is provided with an outer sound hole. The loudspeaker is positioned between the first inner layer and speaker support plate, a waterproof ventilated acoustic membrane is placed to cover the loudspeaker frame, a first waterproof adhesive permanently binds the waterproof ventilated acoustic membrane and speaker support plate together, and a second waterproof adhesive permanently binds the edge portion of the outer sound hole and speaker support plate together, thus, giving the inflatable speaker a higher level of protection.

12 Claims, 8 Drawing Sheets

INFLATABLE SPEAKER

CROSS-REFERENCE TO RELATED APPLICATIONS

This present invention claims the benefit of Chinese Patent Application No. CN201610649665.4, filed on Aug. 9, 2016; the contents of which are hereby incorporated by reference.

FIELD OF THE INVENTION

The present invention relates to a speaker, more particularly, to an inflatable speaker.

BACKGROUND OF THE INVENTION

Most of the traditional speakers are made of hard materials, such as wood, aluminum alloy and so on, wherein their physical sizes can not be changed according to the requirements of the actual usage, which cause inconveniences to the users to a certain extent, such as, such speakers can not be collapsed to a small size for easy carry when on travel or on business trip. To avoid the disadvantages of traditional speakers, the inflatable speaker is invented to meet the demands of the user. For example, the Chinese Utility Patent (Patent No.: 201020637232.5) is disclosed as a portable inflatable speaker, the speaker is provided with an inflatable housing with double structure, an echo hole, a loudspeaker, a sound unit and an audio input interface, the echo hole and the loudspeaker are provided on the shell of the housing, and the sound unit and the audio input interface are positioned on the inside of the housing. The speaker can operate normally when it is inflated, and can be deflated by letting the air out to collapse to a smaller size for easy carry and storage.

There are other types of electronic devises which is also with inflatable design, for example, Chinese Patent 201310419576.7 (hereafter CN201310419576.7) and U.S. Pat. No. 9,016,886 (hereafter U.S. Pat. No. 9,016,886) have published applications directed to an inflatable solar lamp. This kind of inflatable solar lamp is also provided with an inflatable housing, a solar panel positioned on the housing, a rechargeable solar-powered battery, LEDs and electronic circuit board, which form an inflatable solar lamp. Obviously, such kind of electronic devices are with advantages for easy carry and storage.

However, for the inflatable solar speaker, many factors should be considered, like the seal between the speaker and the inflatable housing, the water-proof and dust-proof level of the speaker and other factors, which will improve the protection level of the inflatable speaker, ensuring it can be applied to different kinds of external environment, such as the swimming pool.

SUMMARY OF THE INVENTION

The present invention is aimed at solving the technical problem that provides an inflatable speaker with a higher level of protection.

To solve the above technical problem, the present invention adopts the technical scheme as follows: An inflatable speaker comprises a collapsible inflatable housing and a loudspeaker, wherein the collapsible housing includes a cylindrical side wall, a first end wall positioned on one end of the cylindrical side wall, a second positioned on the other end of the cylindrical side wall, and a valve provided on the cylindrical side wall for inflating the collapsible inflatable housing, wherein the first end wall includes a first inner layer, a first outer layer, and a speaker support plate between the first inner layer and first outer layer, the speaker support plate is provided with an audio transmission inner sound hole, the first outer layer is provided with an outer sound hole that is aligned to the inner sound hole; the loudspeaker is positioned between the first inner layer and the speaker support plate, a waterproof ventilated acoustic membrane is placed to cover the loudspeaker frame, a first waterproof adhesive is placed around the inner sound hole and permanently binds the waterproof ventilated acoustic membrane and the speaker support plate together, and a second waterproof adhesive is placed around the inner sound hole and permanently binds the edge portion of the outer sound hole and the speaker support plate together.

The benefits of the present invention are listed as follows: The loudspeaker is positioned between the first inner layer and the speaker support plate, a waterproof ventilated acoustic membrane is placed to cover the loudspeaker frame, a first waterproof adhesive is placed around the inner sound hole and permanently binds the waterproof ventilated acoustic membrane and the speaker support plate together, while a second waterproof adhesive is placed around the inner sound hole and permanently binds the edge portion of the outer sound hole of the first outer layer and the speaker support plate together, therefore, these not only ensure the bond sealing between the loudspeaker and the collapsible inflatable housing, but also ensure the loudspeaker has good waterproof properties, thus improving the protection level of the inflatable speaker, and ensuring it can be applied to different kinds of external environment.

DETAILED DESCRIPTION OF ILLUSTRATED EMBODIMENTS

Figure 1:
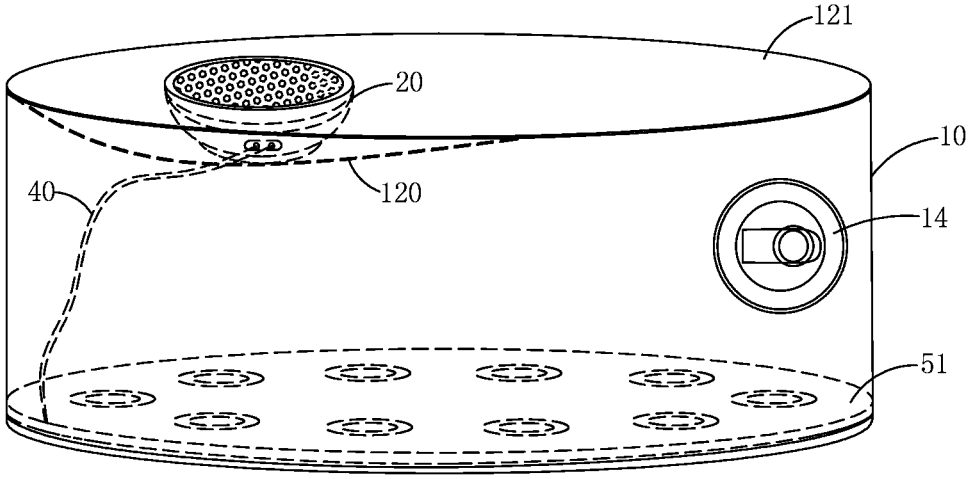
FIG. 1 is a structural view of the inflatable speaker.
Figure 2:
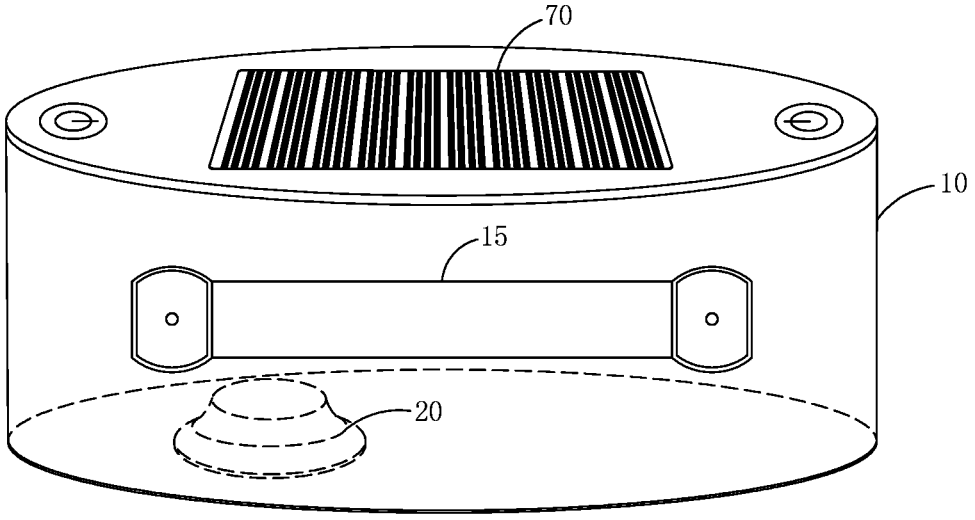
FIG. 2 is a structural view of the inflatable speaker from another angle.
Figure 3:
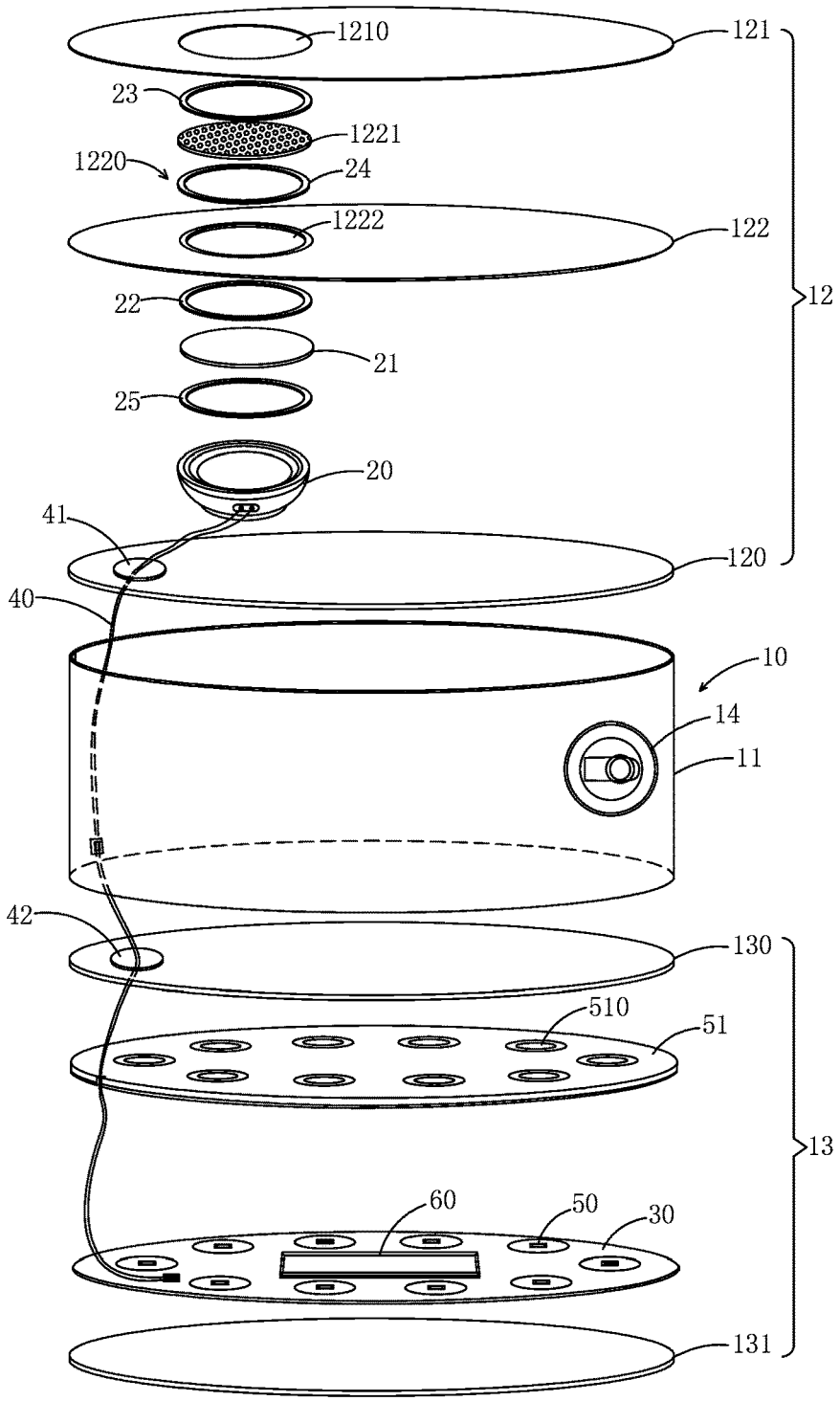
FIG. 3 is an exploded structural view of the inflatable speaker.

The technical problems to be solved, the technical scheme and the technical benefits involved in this present invention should be better understood by the artisan of ordinary skill, further detailed descriptions combined with the drawings and the embodiments are listed as following:

Referring to FIG. 1 to FIG. 3, in some embodiments, an inflatable speaker includes a collapsible inflatable housing 10, the collapsible housing 10 includes a cylindrical side wall 11, a first end wall 12 positioned on one end of the cylindrical side wall 11, a second end wall 13 positioned on the other end of the cylindrical side wall 11, and a valve 14 provided on the cylindrical side wall 11 for inflating the collapsible inflatable housing 10. The collapsible inflatable housing 10 is made of a translucent or transparent soft plastic material, such as Polyvinyl chloride; PVC, Polyethylene; PE, Thermoplastic polyurethanes; TPU, Ethylene-vinyl acetate copolymer; EVA and so on. When in use, the housing 10 forms a standing-cylindrical shape when expanded by inflating the housing 10 with the valve 14, then the inflatable speaker will work normally; the housing 10 will be in the collapsible condition by deflating the housing 10 with the valve 14, then the inflatable speaker will be easy to store and carry. The structures of the collapsible inflatable housing 10 have been described in the patent CN201310419576.7 and U.S. Pat. No. 9,016,886, thereafter the same structures will not be described in details.

Regarding to the embodiment of FIG. 3, the first end wall 12 includes a first inner layer 120, a first outer layer 121, and a speaker support plate 122 between the first inner layer 120 and first outer layer 121, the speaker support plate 122 is provided with an inner sound hole 1220, the first outer layer 121 is provided with an outer sound hole 1210 at the position of the inner sound hole 1220. The loudspeaker 20 is positioned between the first inner layer 120 and the speaker support plate 122, a waterproof ventilated acoustic membrane 21 is placed to cover the loudspeaker frame, a first waterproof adhesive 22 is placed around the inner sound 1220 and permanently binds the waterproof ventilated acoustic membrane 21 and the speaker support plate 122 together, and a second waterproof adhesive 23 is placed around the inner sound 1220 and permanently binds the edge portion of the outer sound hole 1210 and the speaker support plate 122 together.

Figure 4:
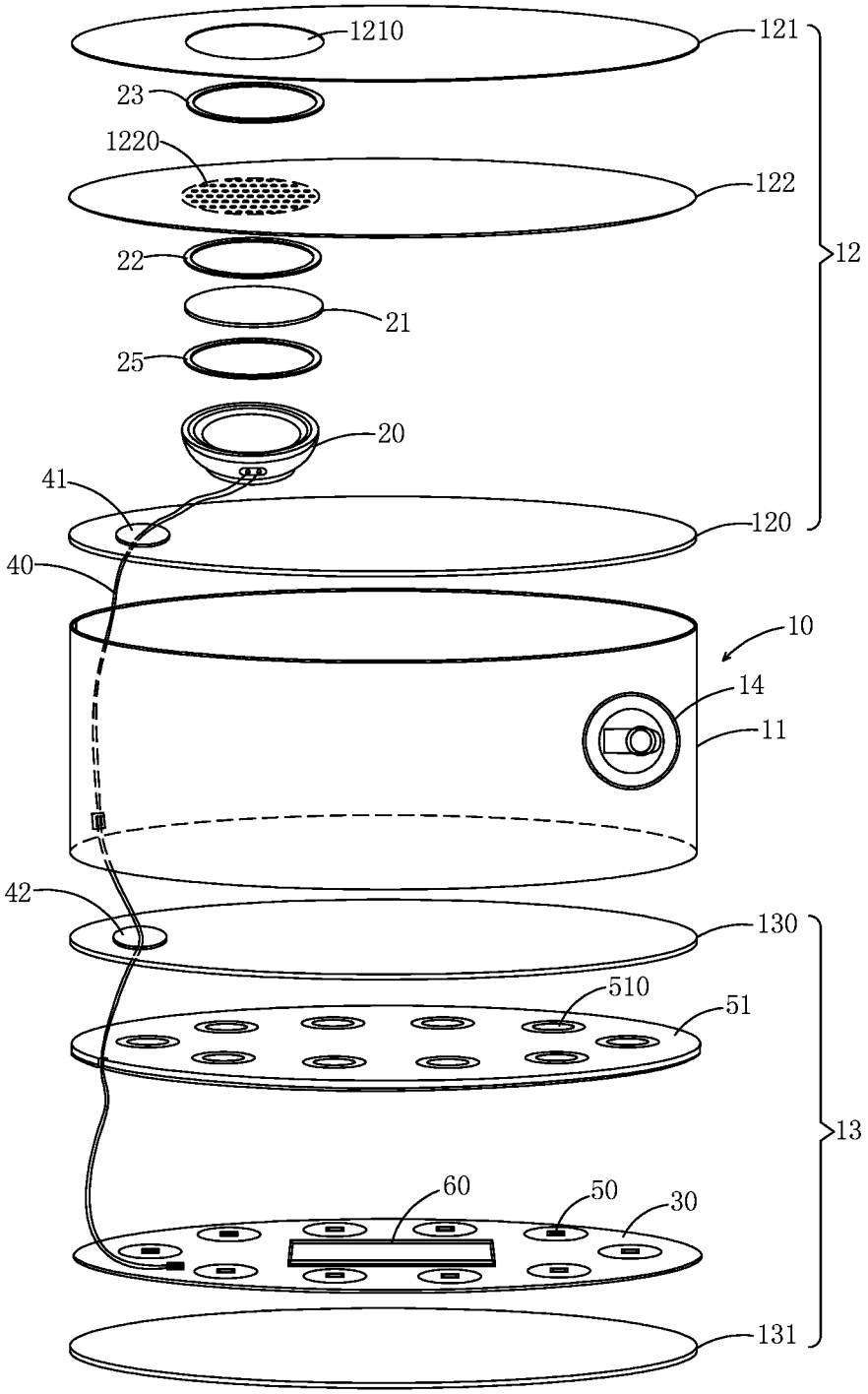
FIG. 4 is an exploded structural view of the inflatable speaker in other embodiment.

Referring to the embodiment of FIG. 3, the inner sound hole 1220 comprises of the speaker mesh 1221 positioned on the speaker support plate 122, the second waterproof adhesive 23 permanently binds the speaker mesh 1221 and the joints of the outer sound hole 1210, the third waterproof adhesive 24 permanently binds the speaker mesh 1221 and the joints of the embedded hole 1222 on the speaker support plate 122. Referring to the embodiment of FIG. 4, the inner sound hole 1220 comprises of multiple outer sound holes positioned on the speaker support plate 122.

In some preferred embodiments, the fourth adhesive 25 permanently binds the waterproof ventilated acoustic membrane 21 and the joints of the loudspeaker 20 frame. The speaker support plate 122 is rigid, which provides the base for holding the loudspeaker 20, and keeping the inflatable speaker in the predefined shape after it is inflated.

The waterproof adhesive can be the waterproof adhesive or adhesive tape in existing technologies, such as PS adhesive, PC adhesive, PA adhesive, PP adhesive, PE adhesive, Rubber cement, Polyurethane adhesive or waterproof double-sided adhesive tape and so on. The waterproof ventilated acoustic membrane can be the membrane with waterproof and acoustic function in existing technologies, such as Polytetrafluoroethene; EPTFE and so on. The membrane with waterproof and acoustic function can be acquired from the commercial market, which will not be listed again.

The loudspeaker 20 is positioned between the first inner layer 120 of the first end wall 12 and the speaker support plate 122, a waterproof ventilated acoustic membrane 21 is placed to cover the loudspeaker 20 frame, meantime, the first waterproof adhesive 22 that is placed around the inner sound hole 1220 permanently binds the waterproof ventilated acoustic membrane 21 and the speaker support plate 122 together, and the second waterproof adhesive 23 that is placed around the inner sound hole 1220 and permanently binds the outer sound hole 1210 on the first outer layer 121 and the speaker support plate 122 together. Therefore, these not only ensure the bond sealing between the loudspeaker 20 and the collapsible inflatable housing 10, but also ensure the loudspeaker 20 has good waterproof properties, thus improving the protection level of the inflatable speaker, and ensuring it can be applied to different kinds of external environment, such as the swimming pool, bathroom and other kinds of humid places.

Referring to FIG. 3, in some embodiments, the second end wall 13 includes a second inner layer 130, a second outer layer 131, and printed circuit board 30 between the second inner layer 130 and the second outer layer 131, printed circuit board 30 is provided with a control circuit (unmarked in FIG. 3), the power amplifier circuit of the control circuit is electrically connected to the loudspeaker 20 through the lead wire 40, which drives the loudspeaker 20.

Referring to the preferred embodiment of FIG. 3, the lead wire 40 comes out from the printed circuit board 30, and goes through the second inner layer 130 of the second end wall 13 and the first inner layer 120 of the first end wall 12 in sequence, and is electrically connected to the loudspeaker 20. The first covering plate 41 is provided on the perforation of the first inner layer 120 for welding the lead wire 40 and the first inner layer 120, the second covering plate 42 is provided on the perforation of the second inner layer 130 for welding the lead wire 40 and the second inner layer 130. The first covering plate 41 and the second covering plate 42 further ensure the collapsible inflatable housing 10 with good sealing and improve the protection level of the inflatable speaker. Preferably, the first covering plate 41 and the first inner layer 120 are made of the same materials which ensure the first covering plate 41 and the first inner layer 120 are well welded; the second covering plate 42 and the second inner layer 130 are made of the same materials which ensure the second covering plate 42 and the second inner layer 130 are well welded.

Figure 5:
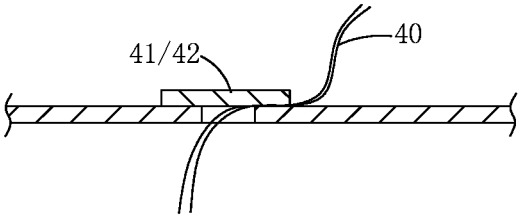
FIG. 5 is a partial structural view of the inflatable speaker, showing the welding state of the covering plate and the inner layer.
Figure 6:
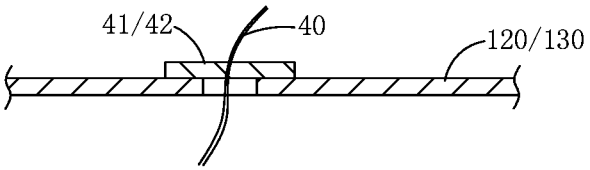
FIG. 6 is a partial structural view of the inflatable speaker, showing the welding state of the covering plate and the inner layer in other embodiment.

Referring to the embodiments of FIG. 5, the lead wire 40 goes through the first inner layer 120/the second inner layer 130, the first covering plate 41/the second covering plate 42 covers the lead wire 40 at the perforation, then the first covering plate 41 and the first inner layer 120/the second covering plate 42 and the second inner layer 130 are respectively welded together by the high frequency voltage machine or the high frequency welding machine. Regarding to embodiments of FIG. 6, the lead wire 40 is provided with the first covering plate 41/ the second covering plate 42, when the lead wire 40 goes through the perforation of the first inner layer 120/the second inner layer 130, it respectively holds the first covering plate 41/ the second covering plate 42 and the first inner layer 120/the second inner layer 130 together, then the first covering plate 41 and the first inner layer 120/the second covering plate 42 and the second inner layer 130 are respectively welded together by the high frequency voltage machine or the high frequency welding machine.

Referring to FIG. 3, in some embodiments, the LEDs 50 are positioned between the second inner layer 130 and the second outer layer 131, wherein the LEDs 50 are electrically connected to the LED driver circuit (unmarked in FIG. 3) and the rechargeable battery 60, the LED driver circuit is provided on the printed circuit board 30, the LED driver circuit draws the direct current from the rechargeable battery 60, and outputs to light up the LEDs 50. As shown in FIG. 3, the LED source 50 comprises of multiple LEDs on the printed circuit board 30, preferably, a reflective cover 51 is provided on the printed circuit board 30, and the reflective cover 51 is provided with multiple light-holes 510 corresponding to the multiple LEDs, the reflective cover 51 can reflect the light rays from the LEDs 50, which can improve the effective luminance of the light.

Regarding to FIG. 2, in some preferred embodiments, a solar panel 70 is provided on one side of printed circuit board 30 close to the second outer layer 131, the solar panel 70 is electrically connected to a rechargeable battery 60 by the charging circuit (unmarked) on the printed circuit board 30. Therefore, the solar panel 70 can charge the rechargeable battery 60 to ensure the power supply of the inflatable speaker.

The settings of the LEDs on the collapsible inflatable housing and the solar panel technology have also been described in the patent CN201310419576.7 and U.S. Pat. No. 9,016,886, which will not be listed again.

Figure 7:
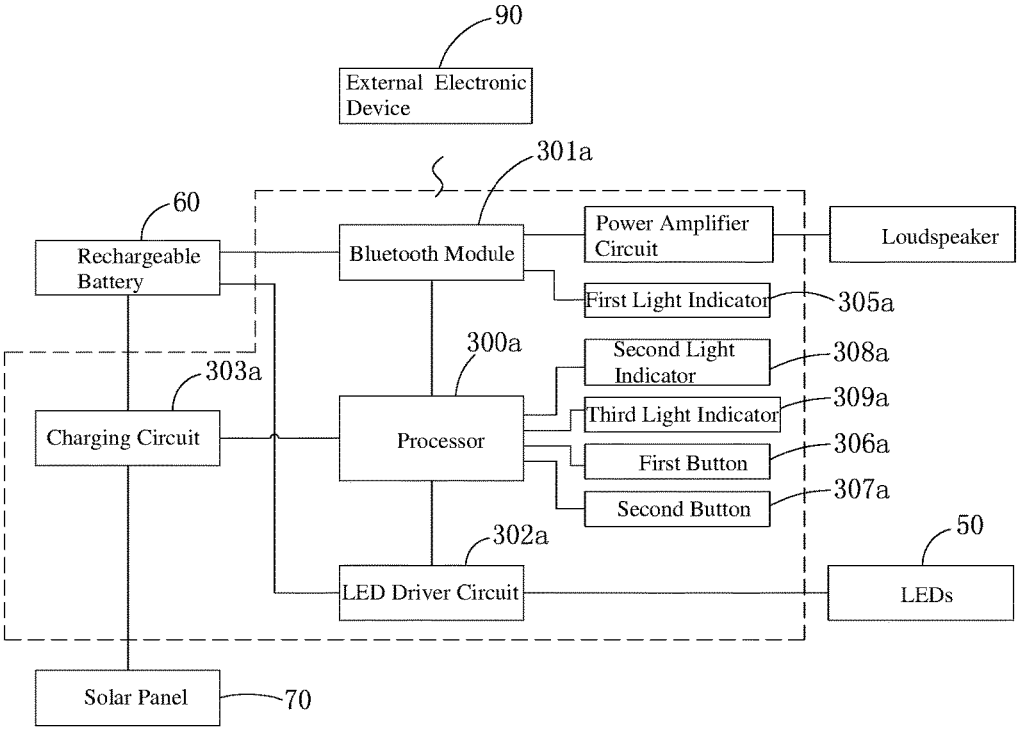
FIG. 7 is a control circuit block view of the inflatable speaker according to the embodiments from FIG. 1 to FIG. 3.

The suitable power amplifier circuit, LED driver circuit and charging circuit in the existing technologies can be applied to the construction of the control circuit of the inflatable speaker of the invention, the detailed structures of those circuits will not be listed here again. FIG. 7 is the block diagram of the applied control circuit 80*a* in the preferred embodiments. The control circuit 80*a* can be applied in the inflatable speakers in the embodiments of FIG. 1 to FIG. 4, which is composed of a speaker driver circuit, LED driver circuit, solar charge control circuit and other circuit units. Referring to FIG. 3 and FIG. 7, the control circuit 80*a* is positioned on the printed circuit board 30, the control circuit 80*a* includes a processor 300*a*, a Bluetooth module 301*a*, a LED driver circuit 302*a* and a charging circuit 303*a*, wherein, the output end of the Bluetooth module 301*a* is connected with a power amplifier circuit 304*a*, and the output end of power amplifier circuit 304*a* is electrically connected to the speaker 20 though the lead wire 40, the Bluetooth module 301*a* is powered by the rechargeable battery 60, and a first light indicator 305*a* is provided to display the working status of the Bluetooth module 301*a*. The Bluetooth module 301*a* receives audio signals from the external electronic devices (such as smart phones, tablet PC, etc), the audio signals are transmitted to the speaker 20 to play after the power is amplified by the power amplifier circuit 304*a*. The LED driver circuit 302*a* is connected between the rechargeable battery 60 and LEDs 50, the direct current from the rechargeable battery 60 is processed and output to power LEDs 50 to light up. The charging circuit 303*a* is connected between the solar panel 70 and the rechargeable battery 60, to control the charging state of the solar panel 70 charging the rechargeable battery 60. The processor 300 is used to control the operation of control circuit 80*a*, and the processor 300 is connected to a first button 306*a* and a second button 307*a* to allow the users to operate, the first button 306*a* is used to control the Bluetooth module 301*a*, and the second button 307*a* is used to control the LED driver circuit 302*a*, meanwhile, a second light indicator 308*a* is provided to display the battery power status of the rechargeable battery 60, and a third light indicator 309*a* is provided to display the charging state of the solar panel. Certainly, the skilled artisan in this field will understand that the control circuit 80*a* is not limited to the structures listed in the figures of the invention, other suitable control circuits in the existing technologies could be also applied.

Referring to FIG. 2, a handle 15 is provided on the collapsible inflatable housing 10, preferably, the handle 15 is made of the same soft plastic materials as the collapsible inflatable housing 10. The users can hang the inflatable speaker on the designated position or they can carry the inflatable speaker by the handle 15.

Figure 8:
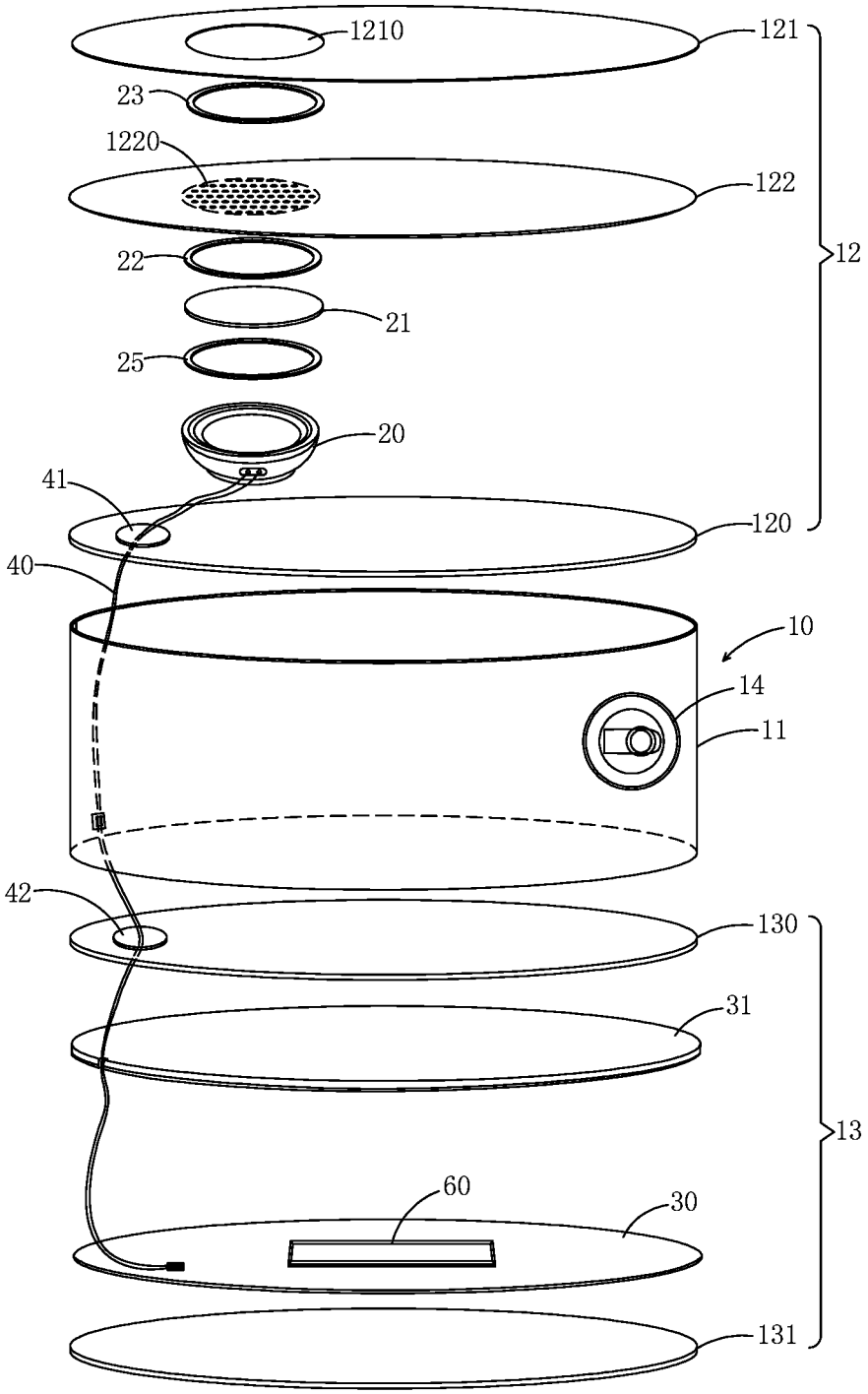
FIG. 8 is an exploded structural view of the inflatable speaker in another embodiment.
Figure 9:
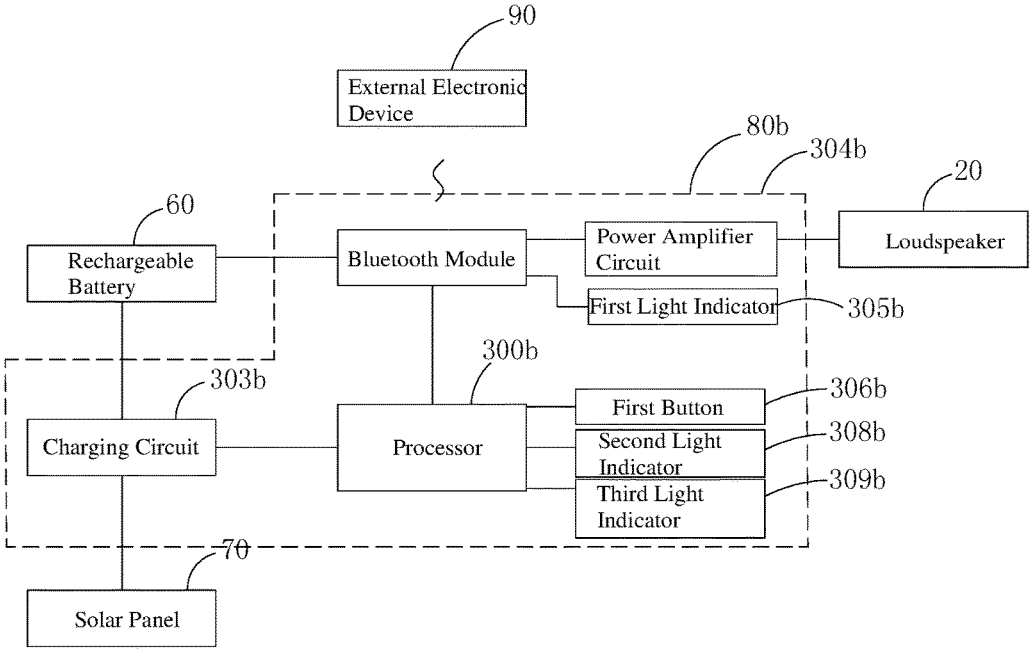
FIG. 9 is a control circuit block view of the inflatable speaker according to the embodiment of FIG. 8.

FIG. 8 shows the structures of the inflatable speaker in another embodiment, the difference between the embodiment in FIG. 3 and the embodiment in FIG. 8 is that the inflatable speaker in the embodiments in FIG. 8 is without lighting function, that is, there are no LEDs 50, correspondingly, there is no reflective cover 51 on the second end wall 13, and there is no LED driver circuit on control circuit 80*a*. Referring to FIG. 8, preferably, the printed circuit board 30 is provided with a cover board 31, the cover board 31 is used to avoid the exposure of the components on the printed circuit board 30, to improve the overall appearance of the product. The control circuit 80 shown in the FIG. 9 can be applied to the inflatable speaker shown in the embodiment in FIG. 8, the control circuit 80 in FIG. 9 includes the speaker driver, solar charge control and other control units. Referring to FIG. 8 and FIG. 9, the control circuit 80*b* is positioned on the printed circuit board 30, and the circuit board 80*b* includes a processor 300*b*, a Bluetooth module 301*b*, and a charging circuit 303*b*, wherein, the output end of the Bluetooth module 301*b* is connected with a power amplifier circuit 304*b*, and output end of the power amplifier circuit 304*b* is electrically connected to the speaker 20 through the lead wire 40, the Bluetooth module 301*b* is powered by the rechargeable battery 60, and a first light indicator 305*b* is provided to display the working state of the Bluetooth module 301*b*. The Bluetooth module 301*b* receives audio signals from the external electronic devices 90 (such as smart phones, tablet PC, etc), the audio signals are transmitted to the speaker 20 to play after the power is amplified by the power amplifier circuit 304*b*. The charging circuit 303*b* is connected between the solar panel 70 and the rechargeable battery 60, to control the charging state of the solar panel 70 charging the rechargeable battery 60. The processor 300*b* is used to control the operation of the control circuit 80*b*, and the processor 300*b* is connected with a first button 306*b*, the first button 306*b* is used to control the Bluetooth module 301*b* to allow users to operate, meanwhile, a second light indicator 308*b* is provided to display the battery power status of the rechargeable battery 60, and a third light indicator 309*b* is provided to display the charging state of the solar panel.

In the above embodiments, the inflatable speaker receives the acoustic signals of the external electronic devices through the Bluetooth Module and other wireless communication technologies. Certainly, the skilled artisan in this field will understand that the inflatable speaker can also receive the acoustic signals of the external electronic devices by wired communication technology or by the audio files stored in the storage device embedded inside of the inflatable speaker.

The above descriptions are only the preferred embodiments of the invention, not limited to any forms of the invention. The skilled artisan can make all kinds of equivalent changes and improvements based on the above embodiments, wherein all equivalent changes and improvements within the scope of the claims of the invention should be under the protective scope of this invention.

What is claimed is:

1. An inflatable speaker comprising:

a collapsible inflatable housing, wherein the collapsible housing includes a cylindrical side wall, a first end wall positioned on the one end of the cylindrical side wall, a second end wall positioned on the other end of the cylindrical side wall, and a valve provided on the cylindrical side wall for inflating the collapsible inflatable housing, wherein the first end wall includes a first inner layer, a first outer layer, and a speaker support plate between the first inner layer and the first outer layer, the speaker support plate is provided with an audio transmission inner sound hole, the first outer layer is provided with an outer sound hole that is aligned to the inner sound hole;

a loudspeaker, the loudspeaker including a frame is positioned between the first inner layer and the speaker support plate, a waterproof ventilated acoustic membrane is placed to cover the loudspeaker frame, a first waterproof adhesive is placed around the inner sound hole and permanently binds the waterproof ventilated acoustic membrane and the speaker support plate together, and a second waterproof adhesive is placed around the inner sound hole and permanently binds an edge portion of the outer sound hole and the speaker support plate together.

2. The inflatable speaker according to claim 1, wherein the inner sound hole comprises of a speaker mesh embedded in the speaker support plate, the second waterproof adhesive permanently binds the speaker mesh with joints of the outer sound hole, a third waterproof adhesive permanently bind the speaker mesh with joints of an embedded hole on the speaker support plate.

3. The inflatable speaker according to claim 1, wherein the inner sound hole comprises multiple outer sound holes positioned on the speaker support plate.

4. The inflatable speaker according to claim 1, wherein a fourth adhesive permanently binds waterproof ventilated acoustic membrane with joints of the loudspeaker frame.

5. The inflatable speaker according to claim 1, wherein the second end wall includes a second inner layer, a second outer layer, and the printed circuit board between the second inner layer and the second outer layer, and a lead wire coming out from the printed circuit board goes through the second inner layer and the first inner layer in sequence, being electrically connected to the loudspeaker.

6. The inflatable speaker according to claim 5, wherein a first covering plate is provided on a perforation of the first inner layer for welding the lead wire and the first inner layer.

7. The inflatable speaker according to claim 6, wherein the first covering plate and the first inner layer are made from the same material.

8. The inflatable speaker according to claim 5, wherein a second covering plate is provided on a perforation of the second inner layer for welding the lead wire and the second inner layer.

9. The inflatable speaker according to claim 8, wherein a second covering plate and the second inner layer are made from the same material.

10. The inflatable speaker according to claim 5, wherein a solar panel is provided on one side of the printed circuit board close to the second outer layer, the solar panel is electrically connected to a rechargeable battery by a charging circuit on the printed circuit board.

11. The inflatable speaker according to claim 10, wherein a LED driver circuit is provided on the printed circuit board and positioned between the second inner layer and the second outer layer, the rechargeable battery is electrically connected to a LED source, the LED source comprises of multiple LEDs on the printed circuit board, a reflective cover is provided on the printed circuit board, and the reflective cover is provided with multiple light holes corresponding to the multiple LEDs.

12. The inflatable speaker according to claim 1, wherein the collapsible inflatable housing is made of a translucent or transparent soft plastic material.

* * * * *